US010068502B1

(12) United States Patent
Sax

(10) Patent No.: US 10,068,502 B1
(45) Date of Patent: Sep. 4, 2018

(54) PHOTOLUMINESCENT CONTAINER

(76) Inventor: Sandra Sax, Las Vegas, NV (US)

( * ) Notice: Subject to any disclaimer, the term of this patent is extended or adjusted under 35 U.S.C. 154(b) by 284 days.

(21) Appl. No.: 12/462,465

(22) Filed: Aug. 3, 2009

Related U.S. Application Data

(63) Continuation-in-part of application No. 11/591,890, filed on Nov. 1, 2006.

(51) Int. Cl.
*G09F 3/20* (2006.01)
*G09F 13/20* (2006.01)

(52) U.S. Cl.
CPC ..... *G09F 13/20* (2013.01)

(58) Field of Classification Search
CPC ..... G09F 13/20; G09F 13/16; G09F 19/22; G09F 13/42; F21V 9/16; F21K 2/00; C09K 11/025; B44C 1/1752; F21S 6/00
USPC ..... 40/542, 543
See application file for complete search history.

(56) References Cited

U.S. PATENT DOCUMENTS

| | | | | |
|---|---|---|---|---|
| 1,168,832 | A * | 1/1916 | Smernoff | 40/790 |
| 2,654,971 | A * | 10/1953 | Harrison | 40/542 |
| 3,017,051 | A * | 1/1962 | Rosenfeld | 248/346.11 |
| 5,695,270 | A * | 12/1997 | Collet | 362/34 |
| 5,698,301 | A * | 12/1997 | Yonetani | 428/213 |
| 6,658,773 | B2 * | 12/2003 | Rohne et al. | 40/542 |
| 2005/0077447 | A1 * | 4/2005 | Martindale-Sharp | 248/346.11 |
| 2006/0097121 | A1 * | 5/2006 | Fugate | 248/311.2 |

* cited by examiner

*Primary Examiner* — Cassandra Davis

(57) ABSTRACT

A container includes a substrate including a brightening agent on its upper surface and a photoluminescent layer on, or impregnated into, the upper surface. The photoluminescent layer on said upper surface absorbs radiant energy and emits radiant energy in the form of light. The substrate is optionally formed from a moisture absorbent material, a moisture resistant material, or a combination thereof. Optionally, an overlay that is substantially light transmissive, that includes an overlay image that is at least partially light transmissive, overlies the substrate. Optionally, a case may be provided to receive and at least partially encase the substrate and, optionally, at least one overlay.

18 Claims, 5 Drawing Sheets

PHOTOLUMINESCENT CONTAINER

RELATED APPLICATION DATA

The present application is a continuation-in-part of U.S. patent application Ser. No. 11/591,890, entitled "Photoluminescent Coaster," filed Nov. 1, 2006 by Applicant herein.

FIELD OF THE INVENTION

The present invention relates to containers for locating and containing items. More specifically, the present invention is a photoluminescent container that includes an overlay with an image.

BACKGROUND OF THE INVENTION

Coasters, trays, ashtrays, and the like are well-known containers. Each of these are typically used to protect the underlying surface from water, burning cigarettes, ashes, hard or sharp edge, or the like as well as to locate and contain the contents. However, these containers are also used to contain objects that are often different from their original intended contents. For example, coasters, trays, ashtrays, cups, and the like are well known receptacles for matchbooks, coins, keys, eyeglasses, and other miscellaneous objects.

Coasters, for example, come in many forms and shapes, but are generally adapted to rest flat on a surface below a glass or bottle and contain the glass or bottle, as well as any condensation on the surface of the glass or bottle. Because coasters are so widespread, and because they provide aesthetic, as well as functional, purposes, restaurants and bars have recognized the advertising utility of coasters, imprinting messages and advertisements on their surfaces, touting their wares and services. Similarly, decorative coasters, which include non-advertising messages and images, are available for homes.

SUMMARY OF THE INVENTION

A container includes a substrate having an upper surface and a lower surface. In an optional embodiment, the substrate may be formed from a moisture absorbent material, such as paper, cardboard, or other pulp-based material, sandstone, or the like. In another optional embodiment, the substrate may be formed from a moisture resistant material, such as plastic, wax, or the like. In a further optional embodiment, the container may include a substrate formed from a moisture absorbent material with a moisture resistant material applied to the lower surface of the substrate.

The substrate has a brightening agent on at least the upper surface of the substrate. The brightening agent could be applied to the upper surface of the substrate or integrated into the material of at least the upper surface of the substrate.

A photoluminescent layer on the upper surface absorbs radiant energy and emits radiant energy in the form of light when the level of radiant energy available for absorption falls below a predetermined level. The photoluminescent layer may be applied to the upper surface or may be impregnated into the upper surface. Optionally, the photoluminescent layer may form a moisture resistant layer over the substrate.

An overlay is provided to overlie the photoluminescent layer. The overlay includes an overlay image. The overlay and at least a portion of said overlay image are substantially light transmissive. For example, in various combinations, the overlay may be transparent or translucent and, likewise, the overlay image may be transparent or translucent.

Optionally, a light transmissive, e.g. transparent or translucent, case is provided to at least partially receive and encase the substrate and removably receive the overlay.

DESCRIPTION

Figure 1:
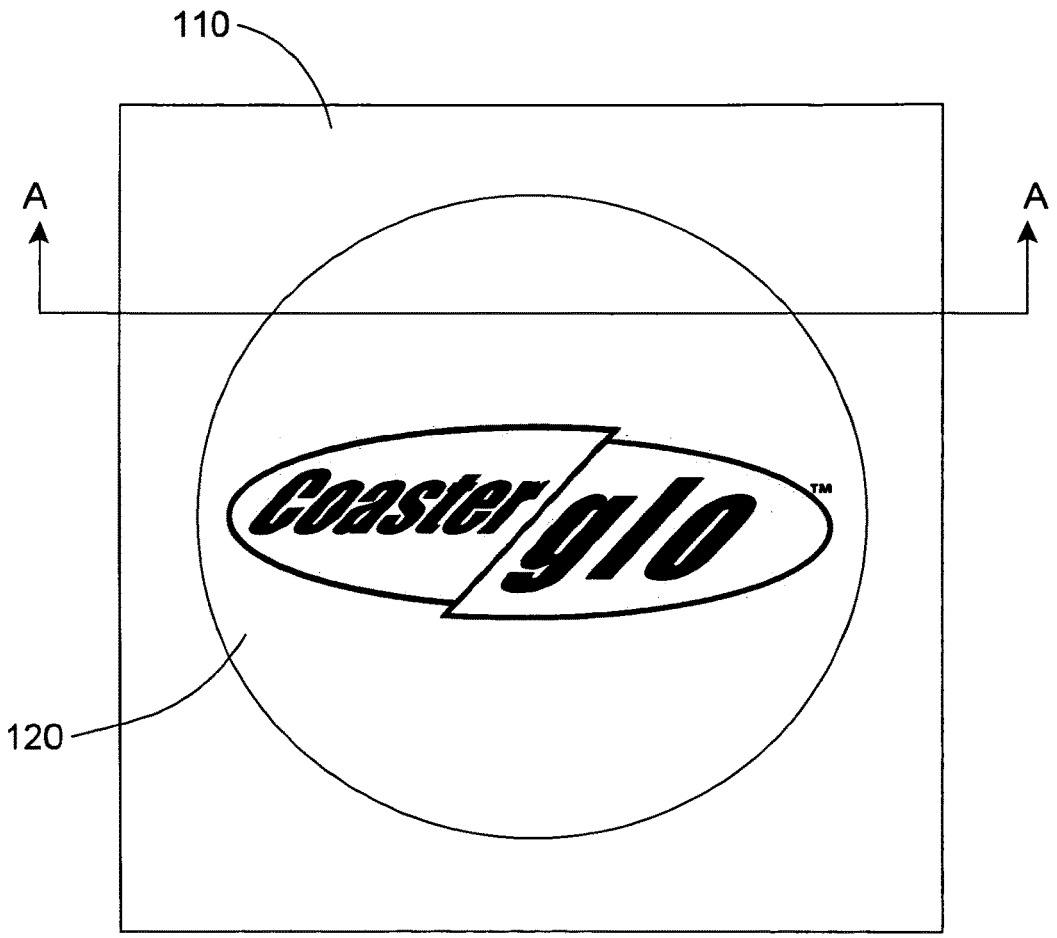
FIG. 1 is a top view of a substrate according to an embodiment of the present invention.
Figure 2:
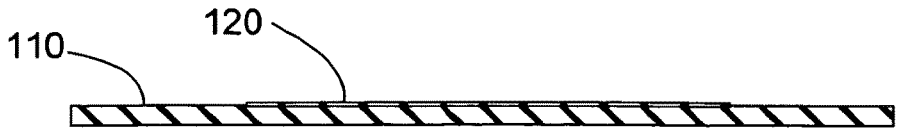
FIG. 2 is a cutaway side view of the optional embodiment of FIG. 1 taken along section line A-A.

Reference is now made to the figures wherein like parts are referred to by like numerals throughout. The device of the present invention is a photoluminescent container that absorbs light and glows in the dark. Referring to FIGS. 1 and 2, a container according to an embodiment of the present invention consists of a substrate 110 with an upper surface and a lower surface.

In an optional embodiment, the substrate 110 may be formed from a moisture absorbent material. Examples of moisture absorbent material could include paper, cardboard, or other pulp materials, wood, cotton or polyester cloth or other natural or synthetic textile material, sandstone, or any other material that tends to absorb water on contact. In another optional embodiment, the substrate 110 could be formed from a moisture resistant material, such as plastic or other polymer, or other materials that tend to resist moisture, prevent scratches, and the like. In yet another optional embodiment, the substrate 110 could be formed from a material with a moisture resistant surface. In such an optional embodiment, the photoluminescent layer 120 (described in greater detail below) may be applied over the moisture resistant surface, under the moisture resistant surface, or may form the moisture resistant surface, at least in part. For example, the photoluminescent layer 120 may form a coating over the substrate 110, at least in the places where it is applied. Those places where the photoluminescent layer 120 is not applied may remain uncoated or may be coated using a sealant or other material.

At least the upper surface of the substrate 110 includes a brightening agent. The brightening agent could include colorants, dyes, pigments, or optical brightening agents. The brightening agent may be integrated into the material forming the substrate 110 or may be applied to the upper surface of the substrate 110. For example, in one optional embodiment the substrate 110 may be a heavy paper stock with a brightening agent integrated into the substrate during the manufacturing process. In an alternate optional embodiment, the brightening agent may be applied to the upper surface of the substrate 110 as a coating, a dye, a stain, a ply or layer (such as a plastic or paper layer), or the like, or otherwise integrated into at least the upper surface of the substrate.

A photoluminescent layer 120 is on the upper surface of the substrate 110. In an optional embodiment, the photoluminescent layer 120 may be applied to the upper surface of the substrate, such as through printing, or otherwise depositing the photoluminescent layer 120 to the upper surface. In another optional embodiment, the photoluminescent layer 120 is impregnated into the upper layer. For example, the photoluminescent layer 120 could be in the form of a paint, ink, dye, or the like that is applied, or otherwise, printed on the substrate 110, optionally over any optical brightener applied to the surface. In another example, the photoluminescent layer 120 may be a layer of material that includes photoluminescent elements (e.g. photoluminescent crystals or the like) integrated into the layer. It is contemplated that the layer may be formed from any type of material, such as polymers or the like and may be separate from, but rest on, the substrate 110 or may be attached, such as with adhesive, bonding agents, or the like, to the substrate 110. Optionally, the layer rests or is attached to the substrate 110 over any optical brightener applied to the surface of the substrate 110. In an optional embodiment, a photoluminescent layer 120 may form a textual or graphical display that is illuminated by the photoluminescent layer 120.

The photoluminescent layer 120 may be formed from any photoluminescent material that absorbs radiant energy and emits light energy. For example, any number of non-radioactive photoluminescent materials could be used including various aluminum oxide ceramic pigments, such as alkaline earth metal aluminate oxide europium doped and alkaline earth metal sulfide europium doped, zinc sulfide, strontium aluminate, or the like. Optionally the photoluminescent material is selected from a photoluminescent material that permits multiple uses, i.e. can absorb radiant energy and discharge light energy over multiple cycles.

Figure 3:
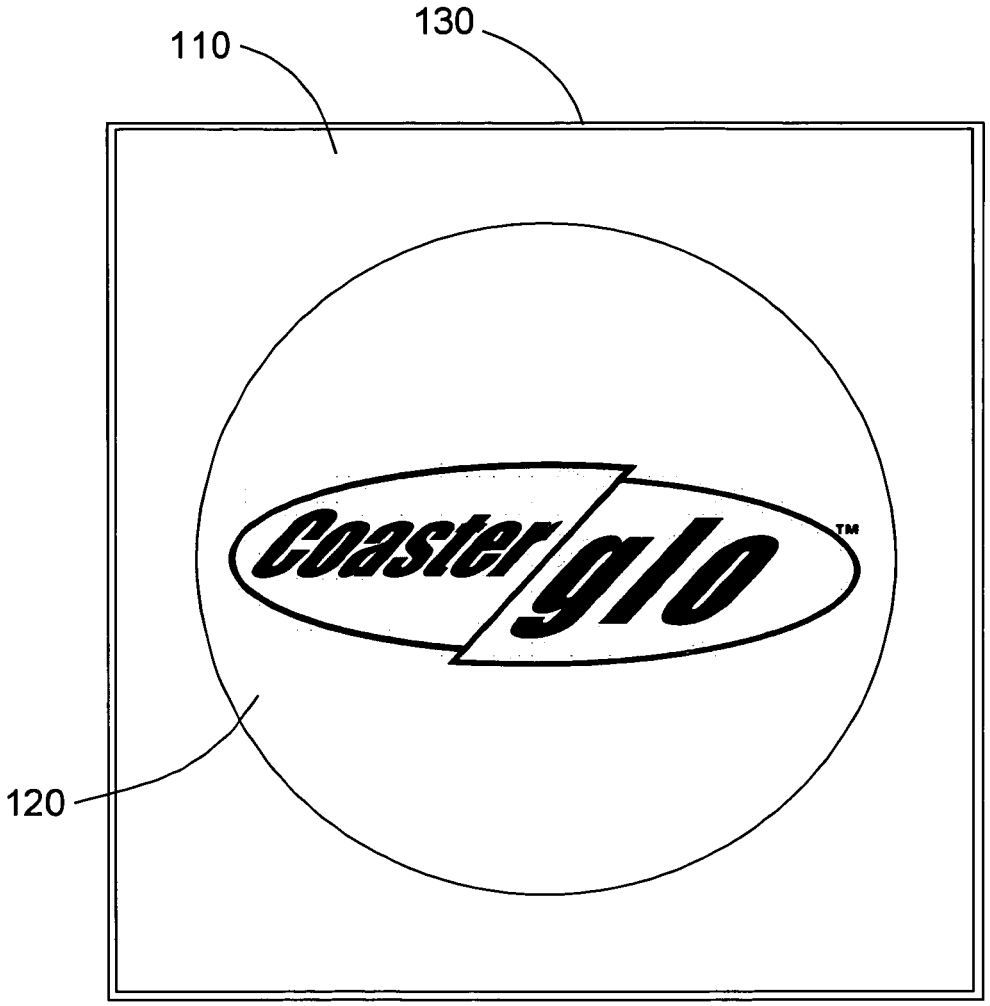
FIG. 3 is a top view of a device according to an embodiment of the present invention.
Figure 4:
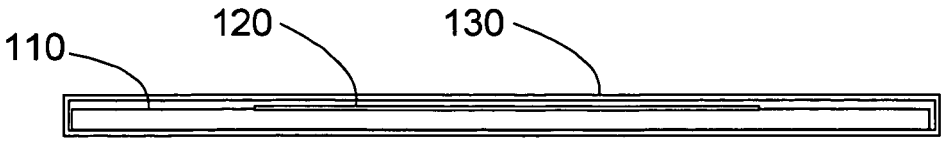
FIG. 4 is a side view of the optional embodiment of FIG. 3

In an optional embodiment illustrated in FIGS. 3 and 4, the substrate 110 may be received into a case 130. The case 130 may be substantially transparent or translucent such as acrylics or plastic through which emitted light may pass. The case 130 at least partially receives and encases the substrate. In an optional embodiment, the case may include a graphical or textual display to complement the photoluminescent layer 120 and cooperate to form a composite graphical or textual display by selectively permitting or blocking the emission of light from the photoluminescent layer. In a further optional embodiment, the case may include a photoluminescent layer to replace or complement the photoluminescent layer on the substrate. In an optional embodiment, the case 130 may include a case image to capture, diffuse, and redirect emitted light from the photoluminescent layer 120. Such case image could be created by many different processes including, but not limited to, etching, embossing, debossing, cutting, or any other process where material is removed or added through mechanical, electrical, or optical (e.g. laser) means.

It is contemplated that a case according to various embodiments of the present invention may include further additions, such as a lamp (not shown) powered by a power source, such as a solar cell, battery, or the like. In an optional embodiment including a battery, the battery may be replaceable, or may be rechargeable, such as through a solar cell. In one such optional embodiment, the lamp may be variably dimmed. In such an optional embodiment, the dimming could be accomplished by reducing the power supplied to the lamp, by changing the transmissivity or polarization of a panel through which the light from the lamp passes, by changing the shape, size, or orientation of an aperture through which the light from the lamp passes, or the like. In this regard, it is contemplated that the light from the photoluminescent layer 120 could likewise be dimmed by changing the transmissivity or polarization of a panel through which the light from the photoluminescent layer 120 passes, by changing the shape, size, or orientation of an aperture through which the light from the photoluminescent layer 120 passes, or the like Referring generally to FIGS. 1-4, a container is utilized by exposing the photoluminescent layer 120 to a source of radiant energy, such as a light source. When the light source is extinguished, the photoluminescent layer 120 emits light energy to glow to make the container, and any object resting on the container such as a drinking glass, visible. In an optional embodiment in which the photoluminescent layer 120 forms a graphical or textual display, the display may be illuminated. Similarly, in an optional embodiment in which the substrate 110 is received into a case 130, any graphical or textual display on or in the case 130 is illuminated.

Figure 5:
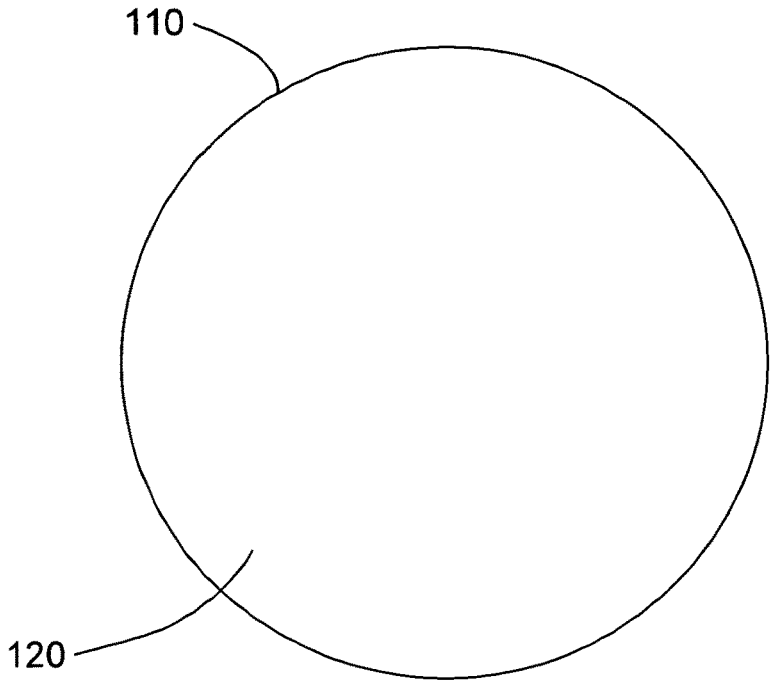
FIG. 5 is a top view of a substrate according to an embodiment of the present invention.
Figure 6:
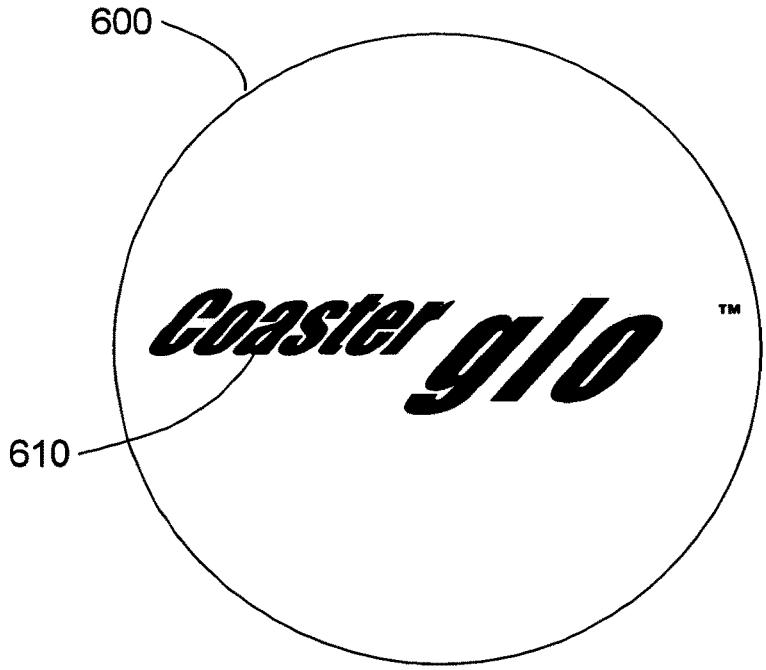
FIG. 6 is a top view of an overlay according to an embodiment of the present invention.
Figure 7:
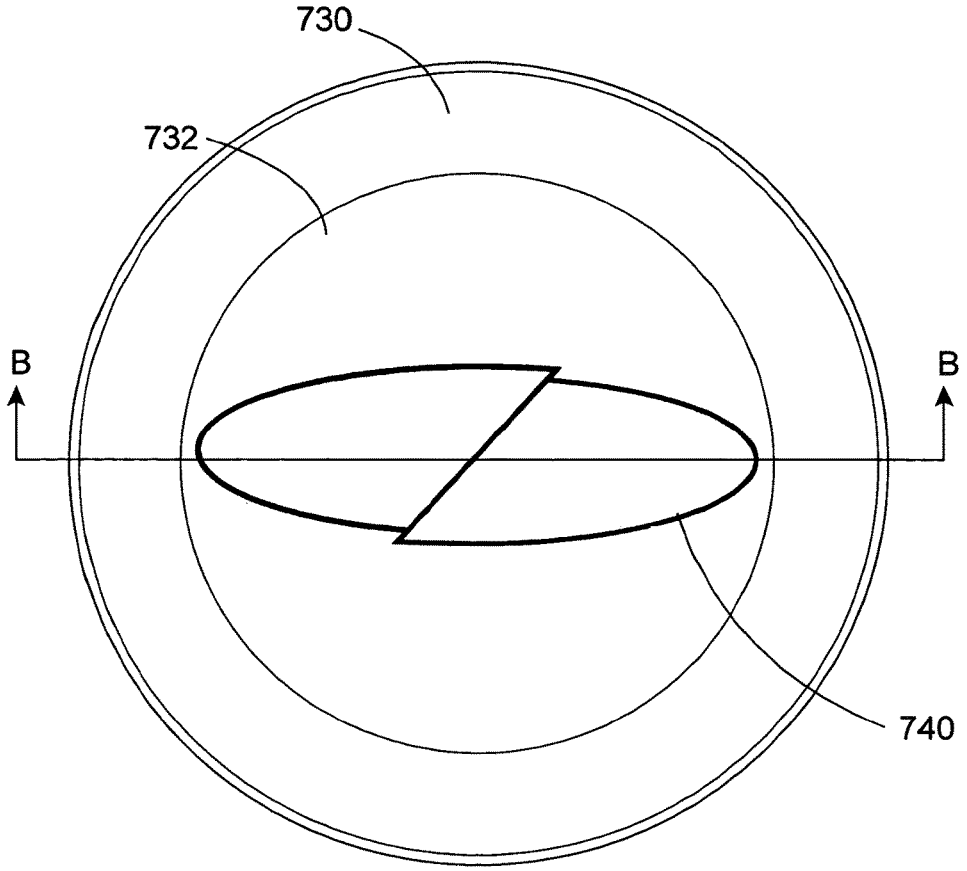
FIG. 7 is a top view of a case according to an embodiment of the present invention.
Figure 8:
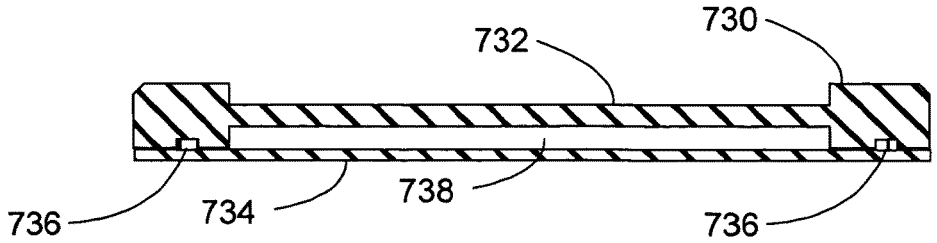
FIG. 8 is a cutaway side view of the optional embodiment of FIG. 7 taken along section line B-B.

In yet another optional embodiment, illustrated in FIGS. 5 and 6, an overlay 600 may overlie the substrate. That is, a substrate 110 may include a photoluminescent layer 120 that covers a portion or all of an upper surface of the substrate 110. An overlay 600 that is at least partly light transmissive, e.g. translucent, transparent, or a combination thereof, may include an overlay image 610. As may be appreciated, the overlay 600 may also include opaque portions to block transmission of light in combination with the light transmissive portions. The overlay image 610 may likewise be at least partly light transmissive, e.g. translucent, transparent, or a combination thereof. When the overlay 600 overlies the photoluminescent layer 120 of the substrate 110, the light emitted from the photoluminescent layer 120 of the substrate is at least partially transmitted through the overlay. Thus, in the example of FIG. 6, if the overlay 600 is substantially transparent everywhere except where the overlay image 610 is located, and the overlay image 610 is substantially translucent, light will pass through the overlay 600 and the overlay image 610 when the overlay 600 is positioned over the photoluminescent layer 120 of the substrate 110. As may be appreciated, multiple overlays 600 may be included with the overlay images 610 that are identical, or complementary, to one another. In such an optional embodiment, the overlay images 610 on the multiple overlays 600 may be aligned to produce depth, color, or other image effects when illuminated by the photoluminescent layer 120 of the substrate 110.

In a further optional embodiment, illustrated in FIGS. 7-10, a substantially light transmissive case 730 may be provided. As discussed above, the case 730 may be at least partially transparent, translucent, or a combination thereof, and may be formed from any material having light transmissive properties, such as polymers like acrylic, glass, or the like. The case 730 may include an indentation 732 to receive a glass, cup, eyeglasses, keys, pills, or the like, to be held in the case 730, as well as a chamber 738 to hold a substrate 110 and overlay 600 to illuminate and decorate the case 730. Optionally, a cover 734 may be provided to hold a substrate 110 and overlay 600 in the chamber. In the optional embodiment of FIGS. 7-10, the cover 734 may be formed from a metal and held in place over the chamber by magnets 736 set into the case 730. In an optional embodiment, the case 730 may include a case image 740. Optionally, the case image 740 is at least partly light transmissive, e.g. translucent, transparent, or a combination thereof, so that light from the photoluminescent layer 120 of the substrate 110 disposed in the case 730 passes through at least a portion of the case 730 and the case image 740.

Figure 9:
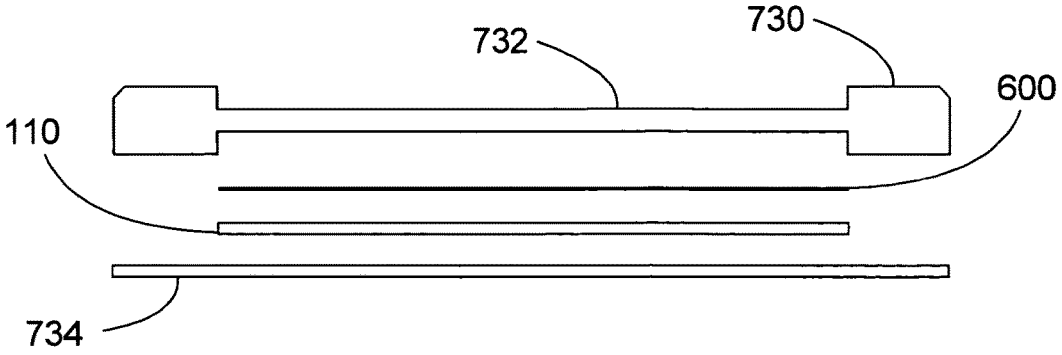
FIG. 9 is a side assembly view of a device including the substrate of FIG. 5, the overlay of FIG. 6, and the case of FIG. 7.
Figure 10:
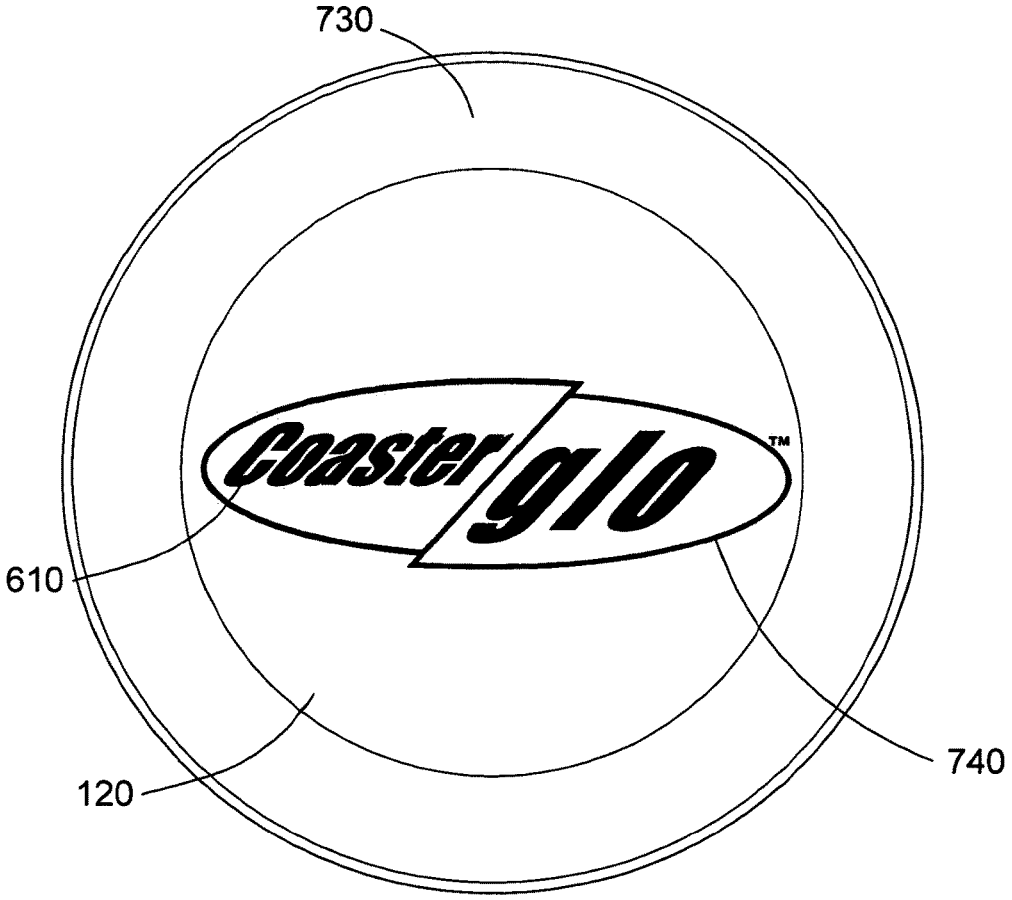
FIG. 10 is a top view of the device of FIG. 9.

Referring to FIGS. 9 and 10, in one example embodiment, the chamber 738 of the case 730 may receive the overlay 600 and the substrate 110. As discussed above, in an optional embodiment, multiple overlays 600 may be received into the chamber 738. It is contemplated that the overlay 600 may be removably received into the case 730 so that it can be changed or customized by the user of the device. That is, an overlay 600 disposed in the case 730 may be combined with, or removed and exchanged for, one or more other overlays to change the appearance of the container device.

The substrate 110 is disposed in the chamber with the photoluminescent layer 120 oriented to direct light through the overlay(s) 600 and the case 730. In the optional embodiment of FIGS. 9 and 10, the overlay image 610 and the case image 740 are complementary in that the overlay image 610 and case image 740 combine to form a composite image when aligned. The overlay 600 and substrate 110 may be secured in the chamber 738 of the case 730 with a cover 734, optionally held in place with magnets 736.

While certain embodiments of the present invention have been shown and described it is to be understood that the present invention is subject to many modifications and changes without departing from the spirit and scope of the claims presented herein.

I claim:

1. A container, comprising:

a substrate having an upper surface and a lower surface, said substrate having a brightening agent on at least said upper surface of said substrate;

a photoluminescent layer on said upper surface absorbing radiant energy and emitting radiant energy in the form of light;

an overlay overlying said photoluminescent layer, said overlay including an overlay image applied thereto wherein said overlay and at least a portion of said overlay image are substantially light transmissive material, wherein said overlay is separate from and removable from said substrate; and a transparent case adapted to receive said substrate and removably receive said overlay such that said substrate and overlay are at least partially encased in said case such that said photoluminescent layer illuminates said overlay image when said substrate is encased in said case.

2. The container of claim 1 wherein said photoluminescent layer is selectively applied to form a display illuminated by said photoluminescent layer.

3. The container of claim 1 wherein said photoluminescent layer is impregnated into said upper surface.

4. The container of claim 1 wherein said overlay and at least a portion of said overlay image are substantially translucent.

5. The container of claim 1 wherein said overlay is substantially transparent.

6. The container of claim 5 wherein at least a portion of said overlay image is substantially translucent.

7. The container of claim 5 wherein at least a portion of said overlay image is substantially transparent.

8. The container of claim 1 wherein said case is transparent and includes a formed image such that said photoluminescent layer illuminates said overlay image when said substrate is encased in said case.

9. A container, comprising:

a substrate having an upper surface and a lower surface, said substrate having a brightening agent on at least said upper surface of said substrate;

a photoluminescent layer on said upper surface absorbing radiant energy and emitting radiant energy in the form of light;

an overlay overlying said photoluminescent layer, said overlay including an overlay image applied thereto wherein said overlay and at least a portion of said overlay image are substantially light transmissive material, wherein said overlay is separate from and removable from said substrate; and a translucent case adapted to receive said substrate and removably receive said overlay such that said substrate and overlay are at least partially encased in said case such that said photoluminescent layer illuminates said overlay image when said substrate is encased in said case.

10. A container, comprising:

a substrate having an upper surface and a lower surface, said substrate formed from a pulp material having a brightening agent on at least said upper surface of said substrate;

a photoluminescent layer on said upper surface absorbing radiant energy and emitting radiant energy in the form of light when the level of radiant energy available for absorption falls below a predetermined level;

an overlay overlying said photoluminescent layer, said overlay including an overlay image wherein said overlay and at least a portion of said overlay image are substantially light transmissive; and a transparent case adapted to receive said substrate and removably receive said overlay such that said substrate and overlay are at least partially encased in said case wherein said case includes a case image such that said photoluminescent layer illuminates said case image and overlay image when said substrate is encased in said case.

11. The container of claim 9 wherein said photoluminescent layer is selectively applied to form a display illuminated by said photoluminescent layer.

12. The container of claim 9 wherein said photoluminescent layer is impregnated into said upper surface.

13. The container of claim 9 wherein said overlay and at least a portion of said overlay image are substantially translucent.

14. The container of claim 9 wherein said overlay is substantially transparent.

15. The container of claim 14 wherein at least a portion of said overlay image is substantially translucent.

16. The container of claim 14 wherein at least a portion of said overlay image is substantially transparent.

17. The container of claim 9 wherein said case is transparent and includes a case image such that said photoluminescent layer illuminates said case image when said substrate is encased in said case.

18. A container, comprising:

a substrate having an upper surface and a lower surface, said substrate formed from a pulp material having a brightening agent on at least said upper surface of said substrate;

a photoluminescent layer on said upper surface absorbing radiant energy and emitting radiant energy in the form of light when the level of radiant energy available for absorption falls below a predetermined level;

an overlay overlying said photoluminescent layer, said overlay including an overlay image wherein said overlay and at least a portion of said overlay image are substantially light transmissive; and a translucent case adapted to receive said substrate and removably receive said overlay such that said substrate and overlay are at least partially encased in said case wherein said case includes a case image such that said photoluminescent layer illuminates said case image and overlay image when said substrate is encased in said case.

* * * * *